United States Patent [19]

Jones et al.

[11] 4,029,068

[45] June 14, 1977

[54] FUEL SYSTEMS FOR INTERNAL COMBUSTION ENGINES

[75] Inventors: Christopher Robin Jones, Alcester; Malcolm Williams, Solihull; Anthony John Adey, Gravesend, all of England

[73] Assignee: Cav Limited, Birmingham, England

[22] Filed: Feb. 13, 1976

[21] Appl. No.: 658,125

[30] Foreign Application Priority Data

Feb. 25, 1975 United Kingdom ..... 7753/75

[52] U.S. Cl. ..... 123/139 E; 180/105 E

[51] Int. Cl.[2] ..... F02M 39/00

[58] Field of Search ..... 123/32 EA, 102, 139 E; 180/105 E; 290/40 A; 317/21, 148.5; 307/102; 322/19

[56] References Cited

UNITED STATES PATENTS

| | | | |
|---|---|---|---|
| 3,556,245 | 1/1971 | Radin | 180/105 E |
| 3,580,355 | 5/1971 | Hitano et al. | 123/102 |
| 3,599,052 | 8/1971 | Carp et al. | 317/148.5 |

*Primary Examiner*—Samuel Feinberg

[57] ABSTRACT

A fuel supply system for an internal combustion engine includes a pump having a control member movable by an actuator. The actuator is powered by an amplifier which receives a control signal from an operational amplifier. One input of the opertional amplifier is connected to a summing junction to which signals representing speed demand, actual speed and control rod position are supplied by three transducers. The signal from the transducer which indicates the control rod position passes by way a circuit means which ensures that a derivative of the signal is applied to the summing junction.

5 Claims, 6 Drawing Figures

FUEL SYSTEMS FOR INTERNAL COMBUSTION ENGINES

This invention relates to a control system for the fuel supply system of an internal combustion engine, the fuel supply system comprising a fuel pump for delivery of fuel to the engine, and control means movable to adjust the quantity of fuel supplied by the pump, and the control system, including an electrical device operable to control the setting of said control means and an electronic control circuit for providing a control signal to said device.

The object of the invention is to provide such a system in a simple and convenient form.

According to the invention, in a control system of the kind specified said electronic control ciruit includes an operational amplifier the output of which is utilised to determine the signal applied to said electrical device, engine speed sensing means for providing a first signal to a summing junction connected to an input of the amplifier, second means providing a second signal which is representative of the setting of said control means, third means for providing a third signal to said summing junction representative of demanded speed, and circuit means interposed between said second means and the summing junction for adjusting the amplitude of the second signal, and for ensuring that a derivative of said second signal is always supplied to said summing junction.

According to a further feature of the invention, said circuit means includes a variable resistor for adjusting the amplitude of said second signal supplied to the summing junction.

According to a further feature of the invention, said circuit means defines two paths, the first of which is resistive and the second of which includes a capacitor so that only the derivative of the second signal passes along said second path to the summing junction.

According to a further feature of the invention, said first path includes a variable resistor operable to adjust the amplitude of the second signal passing along the first path to the summing junction.

According to a still further feature of the invention, said second path includes a variable resistor operable to determine the amplitude of the derivative of the second signal passing along the second path to the summing junction.

According to a still further feature of the invention, said variable resistors are operable together.

According to a still further feature of the invention, said variable resistors are formed by a potentiometer, the opposite ends of the resistor element of which are connected to points in said paths respectively, the slider of the potentiometer being connected to an earthing point and to the other input terminal of the amplifier.

According to a further feature of the invention, the end of the resistance element of the potentiometer is connected by way of a resistor to said point in said second path.

Figure 1:
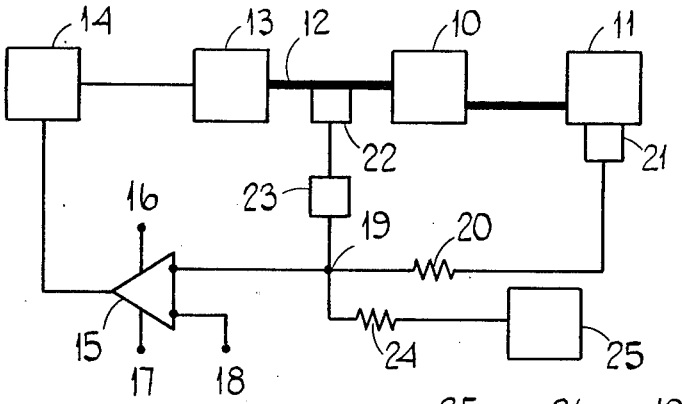
Figure 2:
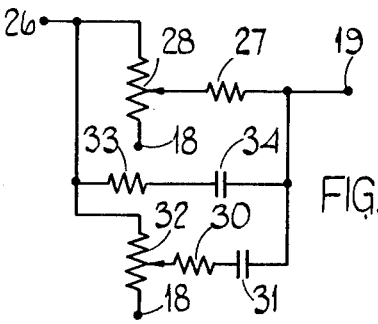
Figure 3:
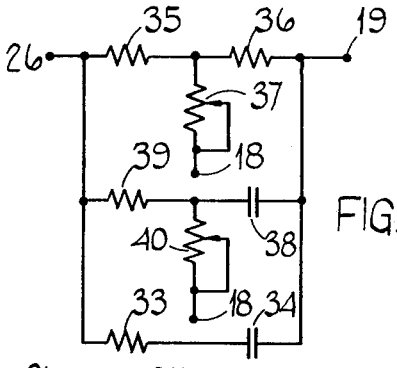
Figure 4:
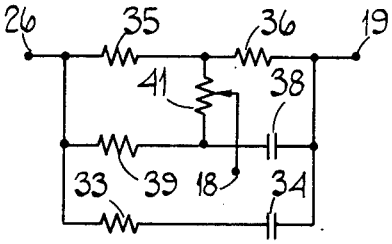
Figure 5:
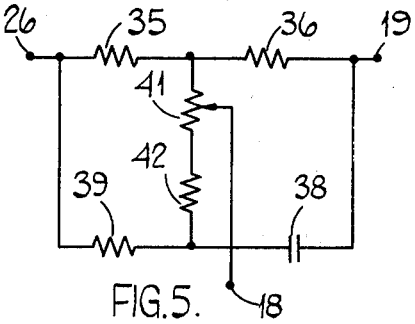
Figure 6:
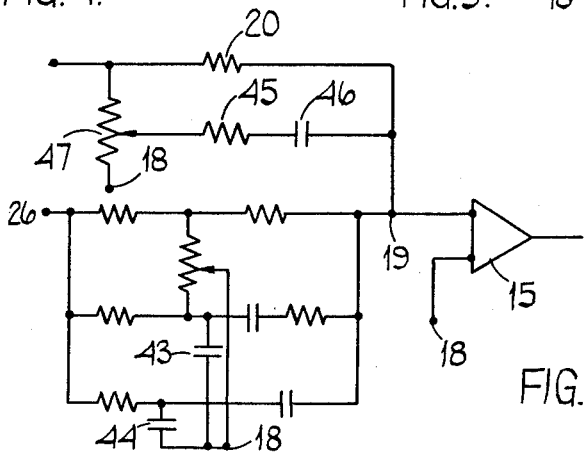

Examples of fuel systems in accordance with the invention, will now be described with reference to the accompanying drawings, in which:

FIG. 1 is a block diagram showing the layout of the fuel system and some of the associated electrical components, FIG. 2 shows one arrangement for one of the blocks seen in FIG. 1, FIG. 3 shows another arrangement of the same block of FIG. 1, FIG. 4 shows a further arrangement of the block shown in FIG. 1, FIG. 5 shows a still further arrangement of the block of FIG. 1, and FIG. 6 shows a circuit which is basically the same as that of FIG. 4 but which includes additional components.

Referring to the drawings, the fuel system includes a fuel pump 10 which is driven by the engine 11 to which fuel is supplied by the pump. The pump includes a control means 12, the setting of which determines the amount of fuel which is supplied by the plump to the engine, and for positioning the control means 12, there is provided an electrical device 13 conveniently in the form of an electro-magnetic actuator.

Power is supplied to the device 13 by means of a power stage 14, and the input to this stage is derived from the output of an operational amplifier 15. Power is supplied to the amplifier 15 by way of a pair of supply terminals 16, 17 which are in use, connected to the positive and negative terminals of a source of d.c. supply. The non-inverting input terminal of the amplifier is connected to a terminal 18 which in use is connected to a supply terminal having a potential midway between the supply terminals 16 and 17.

The inverting input terminal of the amplifier is connected to a summing junction indicated at 19, and this in turn is connected by way of a resistor 20, to a transducer 21 which provides a d.c. output signal substantially proportional to the speed at which the associated engine is driven. The resistor 20 and transducer 21 provide a first signal to the summing junction. A second signal to the summing junction is provided by a transducer 22 which provides a d.c. signal by way of a network 23 representative of the position of the control means, and a third signal is provided to the summing junction by way of a resistor 24 from a device 25 which may be adjusted to provide a demand signal. In the particular application, where the engine is driving a generator, the device 25 may comprise a switch which when in the on position supplies a constant current d.c. signal. In other applications, the device 25 may be adjustable so that a range of engine speeds can be obtained.

In operation, and ignoring the signal provided by the transducer 22, the engine speed will reach a value determined by the current supplied by the device 25. If the engine speed should exceed this value, the supply of fuel to the engine will be turned off, or at least reduced to a minimum value and conversely if for some reason the engine speed has exceeded the value and is decreasing, when the engine speed falls below value, the quantity of fuel supplied to the engine will be increased.

The signal which is supplied from the transducer 22 by way of the network 23, acts firstly to stabilize the system, and secondly it can be used to modify the rate of decrease of fuel or conversely the increase of fuel, when the actual engine speed approaches the demanded speed. Turning now to FIG. 2, there is shown a simple form of the network 23, and it will be seen that the network defines three parallel paths between a terminal 26 which is in fact the terminal which is connected to the transducer 22, and the summing junction 19. The first path is a d.c. path and comprises a resistor 27 which is connected between the summing junction 19 and the slider of a potentiometer 28. One end of the resistor element of the potentiometer 28 is connected to the terminal 26 whilst the other end of the resistor element is connected to the supply terminal 18. Thus, by adjusting the setting of the slider, the amplitude of the signal derived from the transducer and which is supplied to the summing junction can be controlled. The second parallel path includes a further resistor 30, one end of which is connected by way of a capacitor 31 to the summing junction 19, and the other end of the resistor being connected to the slider of a potentiometer 32. The resistor element of this potentiometer is connected in the same way as that of the resistor element of the potentiometer 28. By adjusting the position of the slider of the potentiometer 32, the amplitude of the derivative of the signal obtained from the transducer and which is supplied to the summing junction may be controlled, the third parallel path, comprises a resistor 33 and a capacitor 34 connected in series between the terminal 26 and the summing junction 19. The purpose of the third path is to ensure that even when the slider of the potentiometer 32 is reduced to the minimum or zero value, a derivative signal will still be supplied to the summing junction 19. As previously mentioned, the setting of the potentiometer 28 varies the rate at which the fuel is reduced or increases when the actual speed approaches the demanded speed, and if the slider of the potentiometer 28 is set so that substantially the full amplitude of the signal derived from the transducer is supplied to the summing junction, then the rate of fuel increase or decrease will be reduced. Conversely, if the slider of the potentiometer 28 is set so that no signal passes by way of the resistor 27 to the summing junction, the rate of decrease and increase in the supply of fuel will be extremely high. It is arranged that the sliders of the two potentiometers are coupled but the coupling is such that when the potentiometer 28 provides the maximum signal to the summing junction, the potentiometer 32 provides the minimum derivative signal to the summing junction.

An alternative arrangement is seen in FIG. 3, but again this includes three parallel paths, the first of which is by way of resistors 35, 36 connected in series between the terminal 26 and the summing junction 19. A point intermediate the resistors is connected through a variable resistor 37 to the supply terminal 18. The second parallel path includes a capacitor 38 and a resistor 39, and again a point intermediate these two components is connected to the supply 18 by way of a variable resistor 40. The third path includes the capacitor 34 and the resistor 33 in series therewith. When the values of the resistors 37 and 40 are at a maximum, the maximum signal will be provided by way of the respective paths to the summing junction 19, and as with the previous example, it is arranged that the movable elements of the resistors are positioned so that when the minimum signal flows through the first path, the maximum derivative signal flows through the second path.

The arrangement which is shown in FIG. 4 is substantially identical with that which is shown in FIG. 3 except that in this case, the resistors 37 and 40 of FIG. 3 are combined utilising a potentiometer 41. One end of the resistor element of the potentiometer is connected to the point intermediate the resistors 35 and 36, whilst the other end of the resistor element is connected to a point intermediate the resistor 39 and capacitor 38. Moreover, the slider of the potentiometer is connected to the supply terminal 18.

The arrangement which is shown in FIG. 5, is in many respects similar to that which is shown in FIG. 4, but in this case, the third parallel path comprising the resistor 33 and capacitor 34 of FIG. 4 is omitted. In this case, the end of the resistor element which is connected to the second parallel path, is connected to a point intermediate the resistor 39 and capacitor 38 by means of a resistor 42. The resistor 42 ensures that even when the slider of the potentiometer 41 is adjusted, so that the maximum signal to the summing junction flows by way of the resistors 35 and 36, there will still be a derivative signal flowing by way of the resistor 39 and the capacitor 38.

In the arrangement which is shown in FIG. 6, the network 23 is indentical with that which is shown in FIG. 4. However, FIG. 6 does show the provision of two capacitors 43, 44 each having one plate connected to the supply terminal 18 and the other plates of the capacitors being connected in the second and third paths respectively. The capacitors 43 and 44 provide for transient suppression. FIG. 6 also shows the provision of derivative supply from the transducer 21. This is by way of a resistor 45 and a capacitor 46 connected in series between the summing junction 19 and the slider of a potentiometer 47. One end of the resistor element of the potentiometer is connected to the supply terminal 18 whilst the other end is connected to the output of the transducer 21. The setting of the slider of the potentiometer 47 determines the amplitude of the derivative signal from the transducer 21 which is supplied to the summing junction 19.

It will be appreciated that a very simple fuel system has been described. No mention has been made of circuits which may be utilised to limit the maximum amount of fuel which may be supplied to the engine or indeed the control of the supply of fuel for idling purposes. Such arrangements are fairly well known in the art, and form no part of the present invention.

We Claim:

1. A control system for the fuel supply system of an internal combustion engine, the fuel supply system comprising a fuel pump for delivering fuel to the engine and control means movable to adjust the quantity of fuel supplied by the pump, the control system including an electrical device operable to control the setting of said control means and an electronic control circuit for providing a control signal to said device, the electronic control circuit including an operational amplifier the output of which is utilized to determine the signal applied to said electrical device, engine speed sensing means for providing a first signal to a summing junction connected to an input of the amplifier, second means providing a second signal which is representative of the setting of said control means, third means for providing a third signal to said summing junction representative of demanded speed, and circuit means interposed between said second means and the summing junction for adjusting the amplitude of the second signal, and for ensuring that a derivative of said second signal is always supplied to said summing junction, said circuit means defining two paths, the first of which is resistive and the second of which includes a capacitor so that only the derivative of the second signal passes along said second path to the summing junction, said first path including a variable element operable to adjust the amplitude of the second signal passing along the first path to the summing junction, and including a variable element operable to determine the amplitude of the derivative of the second signal passing along the second path to the summing junction, said variable elements being resistors defined by a potentiometer, the opposite ends of the resistance element of which are connected to points in said paths respectively, said potentiometer having a slider connected to an earthing point and to the other input terminal of the amplifier.

2. A control system according to claim 1 including a resistor in series with the end of the resistance element of the potentiometer and said point in said second path.

3. A control system according to claim 1 including a third path in parallel with said first and second paths, said third path acting to supply a derivative of the second signal to said summing junction irrespective of the setting of the slider of the potentiometer.

4. A control system according to claim 3 including a pair of capacitors connected between said other input of the amplifier and said point in said second path and a point in said third path respectively.

5. A control system according to claim 1 in which said first path comprises a pair of resistors in series, said point in said first path being intermediate said pair of resistors, said second path comprising a further resistor and a capacitor connected in series, said point in said second path being intermediate said further resistor and said capacitor, one end of said further resistor being connected to the summing junction.

* * * * *